US005992359A

United States Patent [19]

Rose

[11] Patent Number: 5,992,359

[45] Date of Patent: Nov. 30, 1999

[54] FLUID ACTUATED ENGINES AND ENGINE MECHANISMS

[76] Inventor: Nigel Eric Rose, 5 Woodvale Drive, Mudgeeraba Gold Coast, Old, Australia, 4213

[21] Appl. No.: 09/103,831

[22] Filed: Jun. 24, 1998

Related U.S. Application Data

[62] Division of application No. 08/663,085, Jun. 13, 1996.

[51] Int. Cl.[6] ..... F02M 37/04; F01L 9/04; F02B 75/04

[52] U.S. Cl. ..... 123/78 E; 123/446; 123/90.11; 123/495

[58] Field of Search ..... 123/446, 495, 123/90.11, 90.12, 90.13, 508, 507, 78 E; 91/403, 404; 92/13

[56] References Cited

U.S. PATENT DOCUMENTS

| | | | |
|---|---|---|---|
| 5,237,968 | 8/1993 | Miller | 123/508 |
| 5,237,976 | 8/1993 | Lawrence | 123/508 |
| 5,622,152 | 4/1997 | Ishida | 123/446 |
| 5,685,272 | 11/1997 | Paul | 123/446 |
| 5,722,373 | 3/1998 | Paul | 123/446 |
| 5,785,021 | 7/1998 | Yudanov | 123/446 |
| 5,806,474 | 9/1998 | Paul | 123/508 |
| 5,826,562 | 10/1998 | Chen | 123/446 |

*Primary Examiner*—Carl S. Miller
*Attorney, Agent, or Firm*—Bauer & Schaffer, LLP

[57] ABSTRACT

A fluid actuator for use in a fluid injector assembly including a piston arranged for reciprocation in a chamber, the piston including a connected plunger operating in an injection chamber. A control valve member is actuated to apply fluid to the chamber on opposite sides of the piston to reciprocate the piston and plunger. A fluid throttling arrangement is provided to decelerate the piston towards the ends of its stroke. The fluid actuator may also be associated with an engine valve assembly.

17 Claims, 7 Drawing Sheets

FLUID ACTUATED ENGINES AND ENGINE MECHANISMS

RELATED APPLICATIONS

This is a divisional application of U.S. patent application Ser. No. 08/663,085, filed Jun. 13, 1996.

TECHNICAL FIELD

This invention relates to fluid actuated engines and engine mechanisms and actuators used therein. In one aspect, the present invention relates to fluid actuators which are applicable to exhaust and inlet valves or fuel injectors of an engine. In a further aspect, the present invention relates to fluid actuated reciprocating internal combustion engines.

BACKGROUND ART

Conventional internal combustion engines are provided with a number of different operating mechanisms for controlling or operating inlet and outlet valves for the engine cylinders or in the case of fuel injected engines for controlling the injectors. Usually such mechanisms take the form of cam shafts, rockers, return springs or other mechanical actuating elements. Such mechanism suffer a number of disadvantages and limitations including in the case of valved engines, poor valve cooling, poor lubrication, a lack of ability to maintain alignment of the valves with their seats, poor control over movement of the valve and an excessive amount of power which is required to overcome the valve seating springs.

Particular disadvantages associated with fuel injectors include lack of flexibility of injection timing, excessive mechanical components in the injector drive train, an excessive amount of power wastage in operating the injectors and their drive train and a lack of ease of assembly and removability of the injectors and associated drive train from the engine during maintenance.

In my International Patent application No. PCT/AU90/00387, I describe hydraulically operated fuel injectors and valves for internal combustion engines wherein an actuator which incorporates dual pistons includes an internal axially extending slide valve for controlling operation of the actuator.

It has been found in practice that the function and control of the above hydraulically actuated fuel injectors and valves has been limited by the excessive stroke length of the control valve causing in the case of fuel injectors an inadequate rate of fuel injection or quantity of fuel injected or in the case of valves inadequate rate of opening or closing of the valve. In addition, there is no readily accessible means for adjusting stroke length for fine adjustment or an efficient means for addressing the problems of component wear. A further disadvantage is that there is no method of addressing the abrupt cessation of motion at stroke end.

In hydraulically operated valves, the above disadvantages lead to a limitation in the number of operational cycles per second and thus the operational speed of the engine.

In my International Patent Application No. PCT/AU90/00387, I also describe an hydraulically operated reciprocating internal combustion engine wherein an hydraulic actuator is coupled to an engine piston arranged for reciprocation within a cylinder to move with or cause reciprocation of the engine piston. The hydraulic actuator includes a number of chamber sections as well as a discharge or vent chamber adjacent to the engine piston through which hydraulic fluid is vented. It has been found in practise that the length of the combined cylinder unit of such engines is unreasonably long and that the discharge of fluid from the vent chamber is inefficient.

SUMMARY OF THE INVENTION

The present invention aims to overcome or ameliorate one or more of the above disadvantages or at least to provide an alternative to the arrangements referred to above.

One object of the present invention is to provide a fluid actuator which when applied to a fuel injector, shortens the period required for injection and raises the rate of injection. A further preferred object is to provide a means for adjustment of stroke length and provide for a gradual cessation of movement at the completion of the stroke of the actuator and injector pistons.

A further object of the present invention is to provide a fluid actuator which when applied to engine valves will lead to an increase in the rate of the opening or closing of valves. A further preferred object is to provide a means for the adjustment of stroke length and provide for a gradual cessation of movement at the completion of the valve stroke.

Yet a further object of the invention is to improve the functioning of fluid actuated engines of the above described type by shortening the overall length of the combined cylinder unit by the elimination of the vent chamber adjacent to the engine piston. A further preferred object is to provide an engine wherein the hydraulic fluid previously discharged through the vent chamber is diverted to do useful work.

Other objects and advantages of the invention will become apparent from the following description.

The present invention thus provides in a first aspect a fluid actuator assembly for use with an engine operating mechanism, said fluid actuator assembly including a chamber, a piston arranged for reciprocating movement within said chamber, an actuating member extending from one end of said piston and through said chamber and comprising an actuating device for said engine operating mechanism, and control valve means arranged externally of said chamber for controlling the supply of fluid to said chamber, said valve means in a first attitude supplying fluid to said chamber to cause said piston and actuating member to move in a first direction, said valve means in a second attitude supplying fluid to said chamber to cause said piston and actuating member to move in a second direction opposite said first direction.

The chamber may include first and second opposite ends and means may be provided for decelerating or cushioning movement of the piston as the piston approaches at least one end of the chamber. The decelerating or cushioning means may comprise means for limiting escape of fluid from the at least one end of the chamber. The decelerating or cushioning means may include throttling means on an end of the piston adjacent the one end of the chamber adapted to be received in a bore communicating with the chamber through which fluid flows, the throttling means cooperating with the bore to increasingly reduce flow of fluid from the chamber as the piston approaches the one end thereof.

The throttling means suitably may include land means on the piston, the land means having a cross section which decreases away from the piston. Preferably the bore is formed in a movable plug engaged with one end of the chamber.

Decelerating or cushioning means may be provided at the opposite ends of the chamber for decelerating or cushioning movement of the piston as it approaches either end of the chamber. The decelerating or cushioning means at the actuating member side of the piston may comprises a flared portion of the actuating member.

The valve means may include a valve chamber and valve means slidable within the valve chamber.

The engine operating mechanism may comprises a fuel injector in which case the actuating member comprises a plunger arranged for reciprocation within an injection chamber. The injection chamber may communicate with the control valve means and the fluid for operating the actuator assembly may comprise the working fluid for an engine for injection upon reciprocation of the plunger.

The injection chamber may communicate with the control valve means through one way valve means and may be arranged to receive fluid from the control valve means upon the control valve means causing retracting movement of the piston.

Alternatively, the engine operating mechanism may comprises an engine exhaust or inlet valve and the actuating member is connected to or formed with a valve head of the engine valve. In this configuration, means may be provided for continuously supplying fluid to one end of the piston, suitably the actuating member end of the piston. The fluid in the one end of the chamber may be directed to the opposite end of the chamber upon the piston being advanced into the one end of the chamber. This reduces the flow required from a fluid source to operate the actuator assembly.

In yet a further preferred aspect, the present invention provides a fluid actuated engine piston-cylinder assembly including a first fluid chamber, piston means arranged for reciprocating movement within said chamber, means coupling said piston means to an engine piston so as to movable therewith, said piston means including first and second spaced apart pistons dividing said chamber into a first chamber section between said first piston and one end of said chamber adjacent said engine piston, a second chamber section between said first and second pistons, and a third chamber section between said second piston and the opposite end of said chamber, fluid inlet means communicating with said second chamber section, valve means for controlling the supply of fluid to said first and third chamber sections from said second chamber section to vary the direction of movement of said piston means, a second fluid chamber adjacent said third chamber section and means for selectively communicating fluid from said first chamber section to said second fluid chamber.

The valve means may comprise a slide valve member arranged for movement in a bore extending longitudinally within the piston means. The communicating means may comprise passage means extending longitudinally of and within the piston means. Alternatively, the communicating means may comprises passage means extending longitudinally of and within the slide valve member.

Cam means may be provided for reciprocating the slide valve member, and the second fluid chamber may surrounding the cam means for lubrication thereof. The valve member may define within the bore a biasing chamber, and means may be provided for communicating fluid to the biasing chamber from the second chamber section for biasing the slide valve member towards the cam means.

The engine piston is arranged for reciprocating movement within a cylinder, and the cylinder may include a cooling jacket and fluid may be supplied to the cooling jacket from the second chamber.

The engine piston assembly described may be used in a multiple format with the engine cylinders arranged in any orientation, for example in-line or radially directed from a common cam shaft carrying a cam or respective cams.

BRIEF DESCRIPTION OF THE DRAWINGS

Reference will now be made to the accompanying drawings which illustrate a preferred embodiment of the invention and wherein.

BEST MODE FOR CARRYING OUT THE INVENTION

Figure 1:
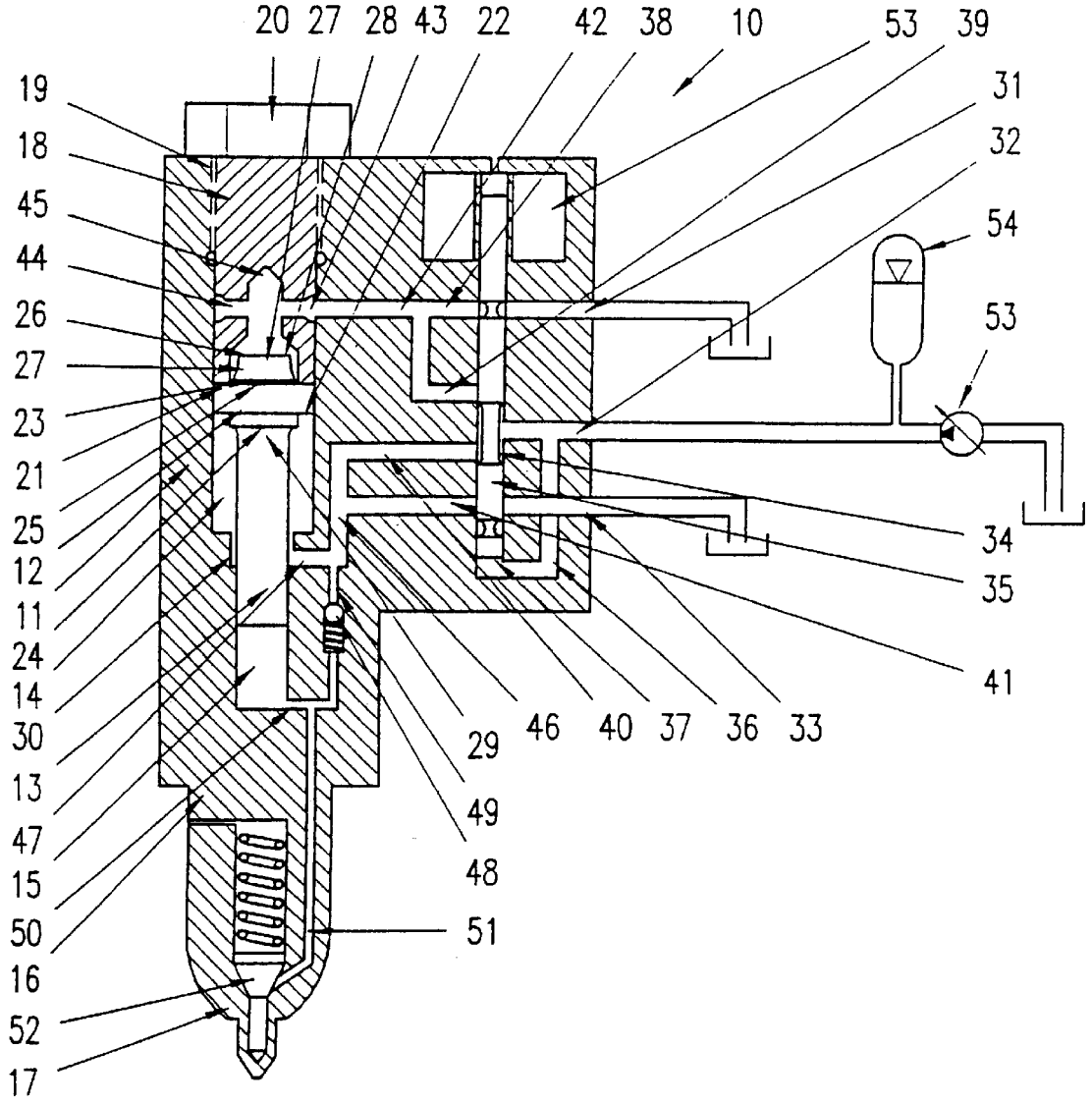
FIG. 1 illustrates in sectional view, an hydraulically operated fuel injector and associated control valve in a first position.

Referring to the drawings and firstly to FIG. 1 there is illustrated an hydraulically actuated fuel injector assembly 10 incorporating a fluid actuator assembly 11 according to the invention, the actuator assembly 11 including a piston 12 and a piston rod 13 which functions in this embodiment as a fuel injector plunger. The piston 13 is arranged for movement within a cylindrical chamber 14 and the plunger 13 is arranged to reciprocate within an injector chamber 15 which is an extension of the chamber 14. Both chambers 14 and 15 are formed within the body 16 which terminates in a fuel injection nozzle 17 of conventional form.

The end of the cylindrical chamber 14 remote from the injector nozzle 17 is closed by a removable plug 18 which is in threaded engagement at 19 with a thread in the end of the cylindrical chamber 14. This permits the plug 18 to be rotated and thereby be moved into or out of the chamber 14 for the purposes of assembly and servicing and for adjusting the stroke length of the piston 12. This may also be achieved for example by the addition or removal of shims between a head 20 of the plug 18 and the body 16 of the injector assembly 10 or alternatively by employing a suitable locking device at the outer end of the plug 18 for temporarily locking the plug 18 against rotation to prevent accidental adjustment.

The piston 12 is double acting and has opposite working faces 21 and 22. Extending from the working face 21 is a central raised land 23. A central cylindrical land 24 also projects from the opposite face 22.

The land 23 tapers in cross section away from the face 21 from a cylindrical portion 26 to an end surface 25 located a distance from the portion 25 through either a curved or straight side surface 27. The plug 18 includes a counterbore 28 aligned with, and adapted to receive the land 23. The counterbore 28 has an internal diameter substantially the same as the external diameter of the cylindrical portion 25. Thus as the piston 12 moves towards its maximum retracted position, the land 23 moves into the counterbore 28 and as the effective cross section of the land 23 increases due to the tapering surface 27 to approach that of the counterbore 28, the movement of the piston 12 is decelerated by the ever more restricted fluid flow allowed between the surface 27 and the counterbore 28.

The land 24 is of a substantially cylindrical form and the piston rod 13 is flared outwardly through either a curved or straight blended surface 29 to join the land 24. A counterbore 30 having a diameter slightly greater than the external diameter of the land 24 is formed between the chamber 14 and chamber 15. Thus as the piston 12 moves during the injection stroke toward its maximum extended position, the blended surface 29 moves into the counterbore 30 and as the effective cross sectional area of the piston rod 13 increases towards the land 24 and to that of the counterbore 30, the movement of the piston 12 is decelerated by the increasingly more restricted fluid flow between the blended surface 29 and the counterbore 30.

The body 16 also has ports 31, 32 and 33 for the entry and exit of hydraulic fluid. In this case the hydraulic fluid also serve the function as the fuel for injection by the injector assembly 10 into the combustion chamber of the engine for subsequent ignition. The two drain ports 31 and 33 may be internally joined prior to exiting the injector body 16. The ports 31, 32 and 33 are connected to a valve chamber 34 containing a control valve member 35. A passage 36 may connect the port 32 to the end of the chamber 34 to supply fluid under pressure to act against an end 37 of the valve member 35 which comprises a piston face to serve as a biasing means for the valve member 35.

Further ports 38, 39, 40 and 41 communicate with the valve chamber 34 and with the chamber 14, the ports 38 and 39 being internally interconnected and connected via a passage 42 with a gallery 43 which communicates through ports 44 with a bore 45 in the plug 18 communicating with the counterbore 28.

The ports 40 and 41 are also internally interconnected and connected to a common passage 46 which is connected via a port 47 to the counter bore 30 and through a one way valve 48 and passage 49 to a port 50 communicating with the injector chamber 15. A further fuel injection passage 51 is connected between the port 50 and needle valve 52 of the injector assembly 10. The port 32 is connected to a fluid source comprising in this instance a pump 53 associated with an accumulator 54.

The control valve member 35 may be operated to allow fluid to be displaced from the chamber 14 through the counterbore 28, central bore 45, ports 44, gallery 43, passage 42 and port 38 and through the control valve chamber 34 for discharge from the injector body 16 through the port 31 (FIG. 1).

In this position also, fluid is supplied under pressure to the port 32 to pass through the control valve chamber 34 and port 40, passage 46, and port 47 into the counterbore 30 and the chamber 14.

This fluid is also supplied via the passage 49 to unseat the check valve 48 and to the injection chamber 15 through the port 50, and through the passage 51 to the needle valve 52. This charges the injector chamber 15 with fuel.

The control valve member 35 may be operated by any suitable means which may comprise a solenoid 53 as depicted or otherwise may be any other suitable mechanical or hydraulic means. The valve member 35 is biased by fluid supplied to the end of the valve member 35 through passage 36. Whilst the biasing means for the valve member 35 of this embodiment comprises fluid pressure, it may comprise a spring or includes a spring which may be locate in the valve chamber 34 at the end of the valve member 35.

Figure 2:
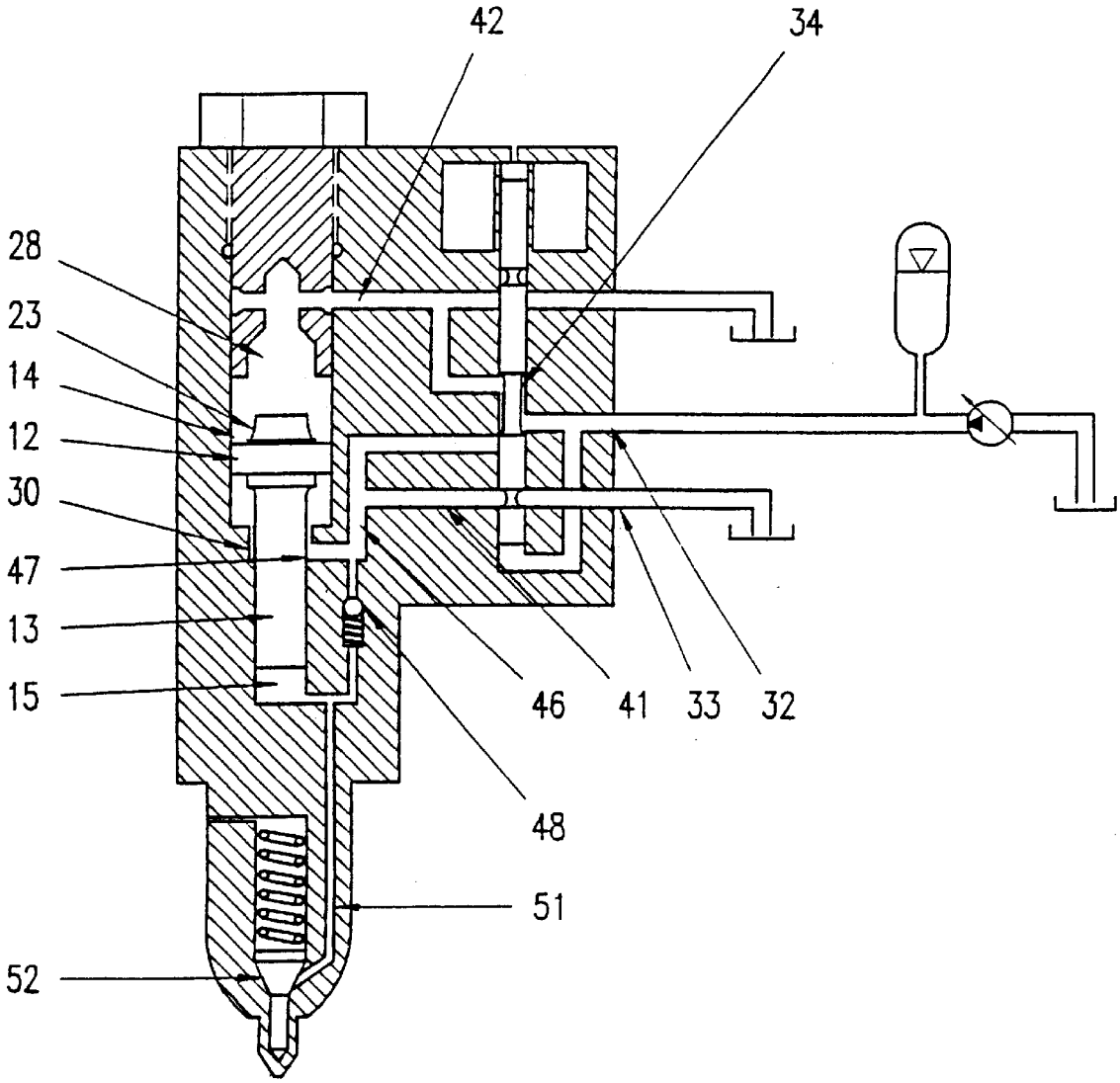
FIG. 2 illustrates the fuel injector in a second position.

With the valve member 35 is actuated to the position of FIG. 2, fluid is supplied to the upper end of the chamber 14 from the port 32 and via the passage 42 to drive the piston 12 downwardly and integral piston rod 13 into the injection chamber 15 displacing fluid from the injector chamber 15, seating the check valve 48 and forcing fluid through passage 51 unseating the needle valve 52 and injecting fluid into the combustion space of the engine. Simultaneously, fluid is displaced from the lower end of the chamber 14 below the piston 12 through the counterbore 30, port 47, passage 46, port 41 passing through the control valve chamber 34 to be discharged from the injector body 16 through port 33 for reuse. As the piston 12 approaches the end of the chamber 14, the passage between the piston rod or plunger 13 and counterbore 30 reduces in cross section due to the flared nature of the piston rod or plunger 13 adjacent the piston 12. This therefore limits or throttles the rate of escape of fluid from the lower end of the chamber 14 to thereby cushion the movement of the piston 12 towards the end of its stroke.

When the valve member 34 is returned to the position of FIG. 1, fluid is supplied to the lower side of the chamber 14 below the piston 12 moving the piston 12 upwardly and withdrawing the attached piston rod or plunger 13 in the injector chamber 15 allowing the unseating of the check valve 48 and the supply of fluid through the port 50 into the injection chamber 15 and priming the needle valve 52 via the passage 50. Simultaneously the movement of the piston 12 displaces fluid from the upper portion of the chamber 14 through the counterbore 28, central bore 45, ports 44, gallery 43, passage 42 and port 38 through the control valve chamber 34 to exit from the injector body 16 via the port 31 for reuse. As the piston 12 approaches the upper end of the chamber 14 defined by the plug 18, the land 23 enters the counterbore 28 which will therefore increasingly limit the cross-sectional area of the passage between the land 23 and counterbore 28 to limit or throttle the rate of escape of fluid from the upper side of the chamber 14. This will therefore cushion the piston 12 in its movement towards the plug 18.

Injection pressure is developed by the amplification of fluid pressure within the injection chamber 15 during the injection stroke due to the area differential between the top working surface of the piston 12 and end face of the piston rod or plunger 13 with the mechanism of the injector tip 17 following existing practice.

Figure 3:
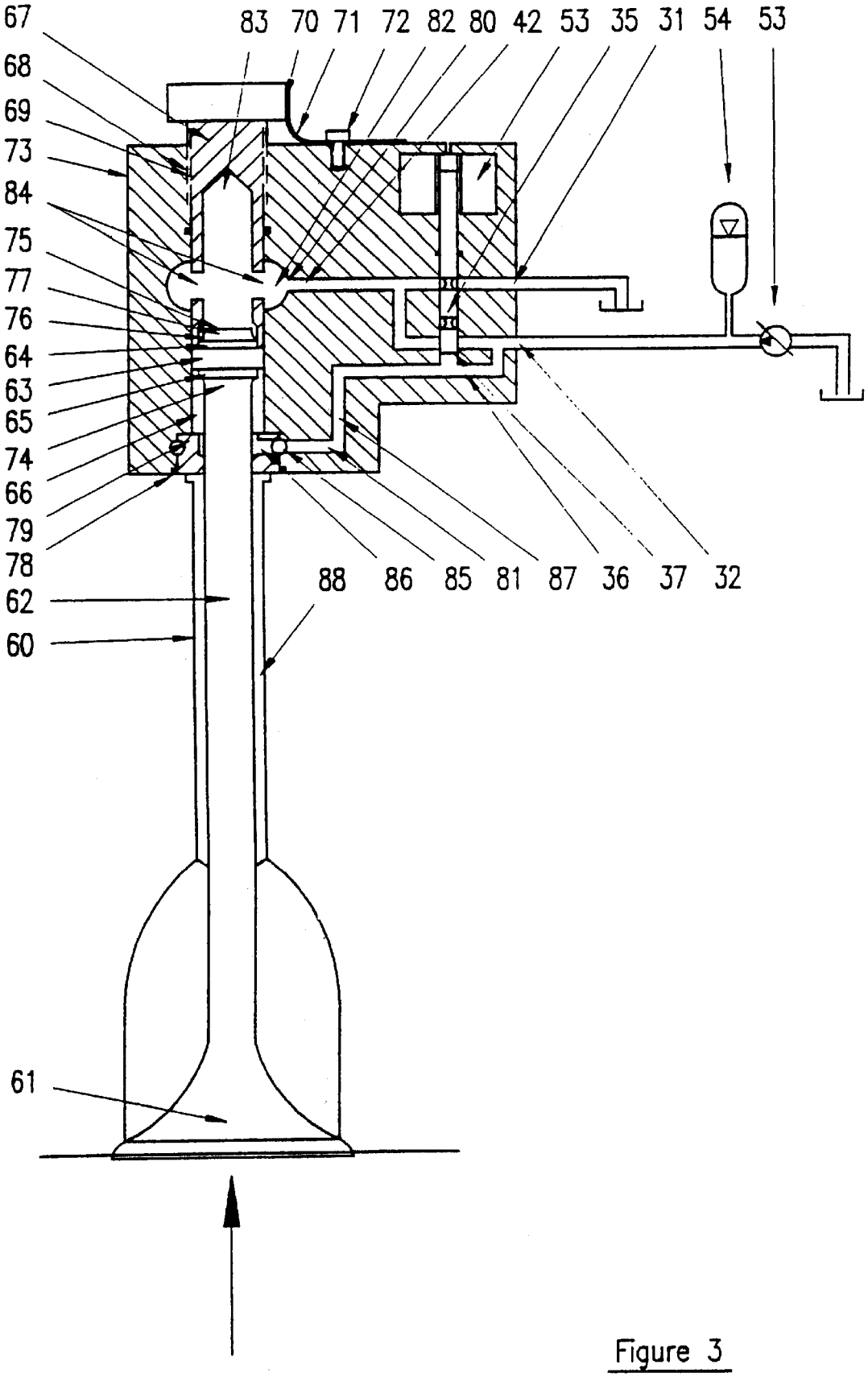
FIG. 3 illustrates in sectional view, a hydraulically operated engine valve mechanism with the valve held closed.
Figure 4:
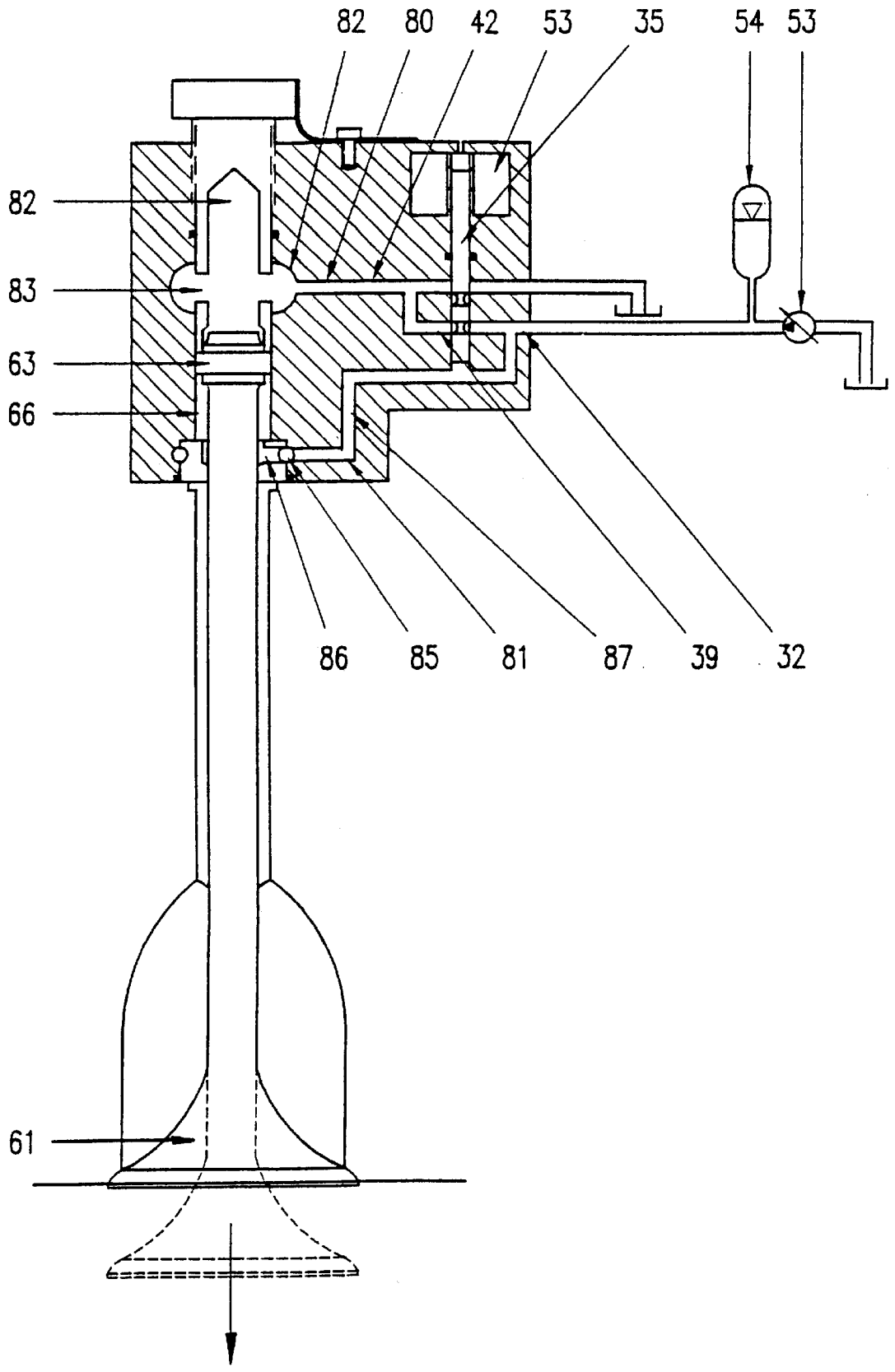
FIG. 4 illustrates in sectional view, the valve mechanism with the valve at the point of opening.

Referring now to FIGS. 3 and 4, there is illustrated an application of the fluid actuator assembly of the invention to the control of an engine valve assembly 60 including a valve head 61 having a valve stem 62 which includes or which has mounted to it a piston 63 which is of similar configuration to the embodiment of FIGS. 1 and 2 and includes lands 64 and 65 on opposite sides. The piston 63 is movable within a cylindrical chamber 66 with the end towards the valve head 61 being fixed whilst the end remote from the valve head 61 is in the form of a plug 67 having a fine screw thread 68 operating in a similar screw thread 69 within the outer portion of the cylindrical chamber 66 for moving the plug 67 into or out of the chamber 66 for the purposes of adjusting the stroke length of the valve assembly 60. At the outer end of the plug 67, suitable locking means 70 may be provided for temporarily locking the plug 67 against rotation to prevent accidental movement, the locking means 70 in this embodiment comprising a strap 71 which may be fixed by a screw 72 to the body 73 of the assembly.

The land 65 joins the valve stem 62 through either a curved or straight flared section 74 whilst the land 64 is extended to a surface 75 a workable distance above the adjacent piston face with a similar blended curved or straight section 76 therebetween such that the land 64 is of tapering configuration away from the piston 63. The plug 67 includes a counterbore 77 aligned with the land 64 and a further counterbore 78 is provided in an insert 79 at the opposite end of the body 73. Thus as the valve assembly 62 moves towards its maximum stroke position in either direction the blended surfaces 74 or 76 move into the counterbores 77 and 78 at either end of the chamber 66, the passage for escape of fluid decreases in cross section such that the movement of the valve assembly 60 is decelerated by the ever more restricted fluid flow through the annular passage between the lands 64 or 65 and the bores 77 or 78.

The cylindrical bore 66 has ports 80 and 81 for the entry and exit of hydraulic fluid. The port 80 communicates with a gallery 82 which allows the flow of hydraulic fluid into or out of the cylindrical chamber 66 via a central bore 83 and the counterbore 77 in the plug 67 through ports 84 in the plug 67.

The port 81 communicates with a gallery 85 allowing the flow of hydraulic fluid into or out of the cylindrical chamber 66 via a port 86 in the insert 79 containing the counterbore 78.

For ease of assembly the insert 79 may be made as a removable split collar as depicted or otherwise may be a component of the chamber 66 and in this latter case the gallery 85 is omitted.

Hydraulic fluid may be supplied under pressure and vented from the chamber 66 by means of a supply system and control valve assembly similar to the type described and shown in FIGS. 1 and 2 and in which like components have been given like numerals. In this case however, a supply passage 87 extends from the passage 36 to the port 81. This always provides a fluid supply from the pump 53 (or other supply) to the lower end of the chamber 66.

In the position of FIG. 3, hydraulic fluid is supplied through the port 32, passages 36 and passage 87 to the gallery 85 and port 86 to the lower end of the chamber 66 to urge the piston 63 upwardly and the engine exhaust or inlet valve head 61 to a closed position. Where the control valve member 35 is actuated by the solenoid 53 to the position of FIG. 4, the hydraulic fluid is directed from the port 32 by the valve member 35 through the port 39, through the passages 42 and port 80 to the gallery 82 to pass through the ports 84 and central bore 83 to the upper end of the chamber 66 to act against the surface 75 and the adjacent face of the piston 63 driving the valve head 61 open (as shown in dotted outline) and expelling hydraulic fluid from the lower end of the chamber 66 through the port 86, gallery 85 and passage 87. This fluid passes back through the port 32 to join the flow from the pump 53 and/or the accumulator 54 to the upper end of the chamber 66 allowing a higher rate of movement of the valve head 61 and reducing the fluid demand upon the pump 53 and/or the accumulator 54.

When the valve member 35 is actuated to move back to the position shown in FIG. 3, it closes the supply of pressurised hydraulic fluid to the upper end of the chamber 66 whilst allowing the venting of fluid from the upper end of the chamber 66 through the central bore 83, ports 84, gallery 82, port 80, passages 42 and the control valve chamber 34 which is directed away through port 31 for reuse. The pressure of the hydraulic fluid entering the lower end of the chamber 66 acting against the land 65 and the adjacent face of the piston 63 drives the valve head 61 closed and expels hydraulic fluid from the upper end of the chamber 66. As the piston 63 approaches each end of the chamber 66 its movement is cushioned through the cooperation between the lands 64 or 65 and the counterbores 77 or 78 respectively in manner as described above and in a similar manner as described with reference to FIGS. 1 and 2.

In some cases the screw thread of the plug 67 and chamber 66 may be omitted and stroke adjustment be performed by the addition or removal of shims with the plug 67 and shims retained by any suitable means.

The biasing means of the control valve may include or consist of a spring and a suitable means of limiting the stroke of the control valve member may also be included.

For ease of assembly the valve guide 88 about the valve stem 62 may take the form of a split valve guide.

Figure 5:
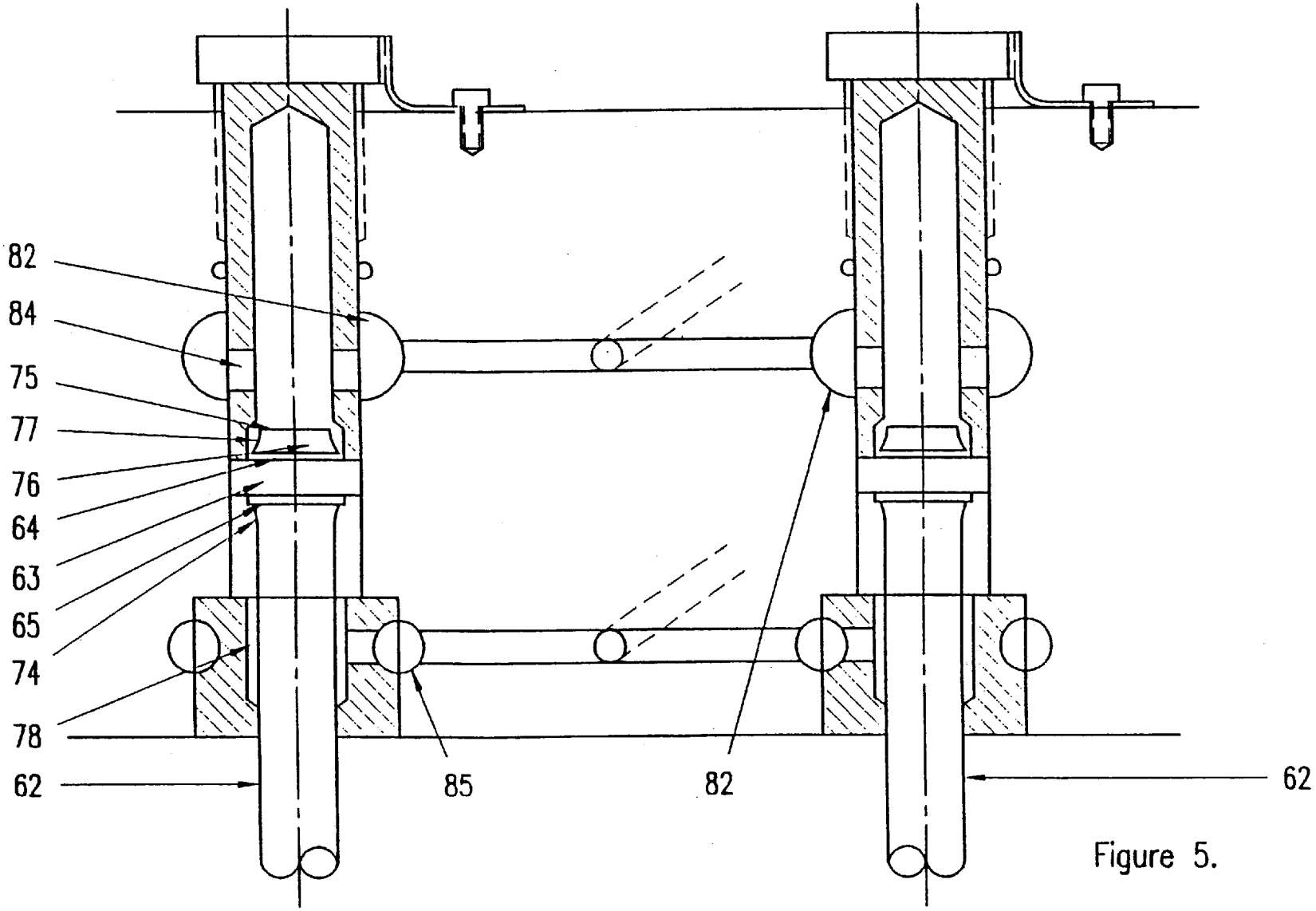
FIG. 5 illustrates in enlarged view, details of one of a number of possible multiple valve configurations.

One controlling mechanism may control the operation of any number of valves in multi-valved engine applications. Typical connections between valve assemblies are shown in FIG. 5 where the respective galleries 82 and 85 are fluidly interconnected. FIG. 5 also shows in enlarged view the arrangements for cushioning or decelerating movement of the piston. Of course the arrangement described above may be used with both inlet and exhaust valves.

The control valves for controlling the operation of both the injector actuator and valve actuator are shown and described to be in the form of slide valves. They may however comprise any form of valve.

Figure 6:
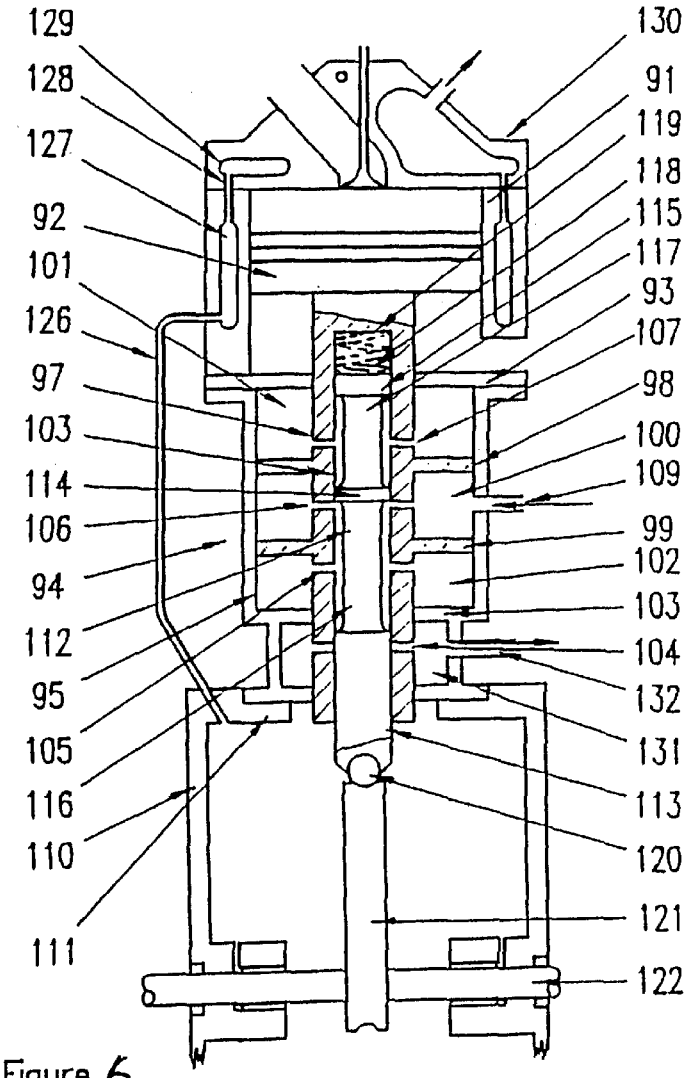
FIG. 6 is a section through a cylinder unit of an engine according to the present invention.

Referring now to FIGS. 6, there is illustrated in sectional view a piston/cylinder unit 90 for an engine according to a further embodiment of the present invention which may comprise a spark ignition engine or a compression ignition engine and be operated either as a four cycle or two cycle engine and for this purpose may incorporate conventional means for the supply of fuel and the removal of exhaust products.

As shown, the piston/cylinder unit 90 includes an engine cylinder 91 containing a piston 92 arranged for reciprocation in the cylinder 91. Mounted in line with the cylinder 91 but separated therefrom by a partition 93 which seals off the cylinder 10 is a housing 94 which defines a cylindrical operating chamber 95 also sealed off by the partition 93.

Arranged within the chamber 95 is a piston assembly 96 of the type described in my aforementioned International patent application which includes a hollow tubular piston rod or sleeve 97 having mounted thereon or formed integrally therewith a pair of spaced pistons 98 and 99 which are arranged for reciprocation within the chamber 95. The pistons 98 and 99 divide the chamber 95 into a supply section 100 between the pistons 98 and 99 and opposite end sections 101 and 102 between the piston 98 and wall or partition 93, and piston 99 and a further fixed end wall 103 of the housing 94.

The piston rod or sleeve 97 includes a series of ports 104, 105, 106, and 107 which communicate with an internal bore 108 within the rod or sleeve 97. The housing 94 includes a port 109 for connection to a supply of hydraulic fluid. A further hollow housing or casing 110 is located at the end of the housing 94 opposite the engine cylinder 90 and defines a mounting 111 for the housing 94 which may be connected thereto by bolting.

Located within the bore 108 for reciprocating movement therein is a slide valve member 112 which includes spaced lands 113, 114 and 115 separated by annular grooves 116 and 117. The land 115 of the valve member 112 defines in the end of the bore 108, a chamber 118. A return spring 119 (shown in dotted outline) may be located within the chamber 118 to apply a return biasing force to the valve member 112. This however may also be achieved hydraulically or by other means as described further below.

The opposite end of the slide valve member 112 may be fitted with a cam follower 120 for engagement with a rotatable cam 121 supported on a rotatable cam shaft 122 which passes through the casing 110 and which is sealed thereto.

Figure 7:
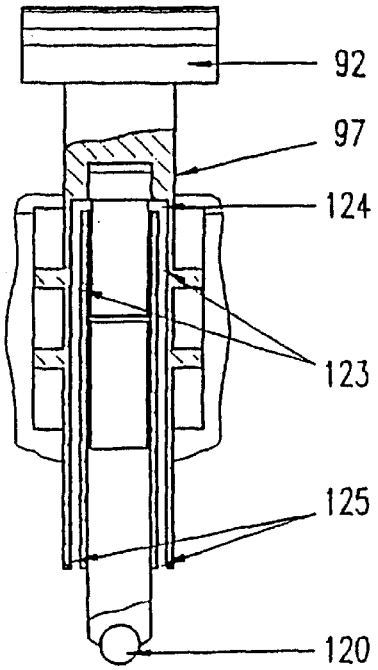
FIG. 7 is a rotated section through a part of the cylinder unit of FIG. 6 showing part of the modified porting.
Figure 9:
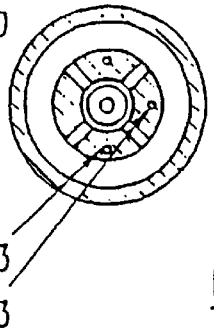
FIG. 9 is a section across the cylinder unit showing a typical arrangement of the ports.
Figure 10:
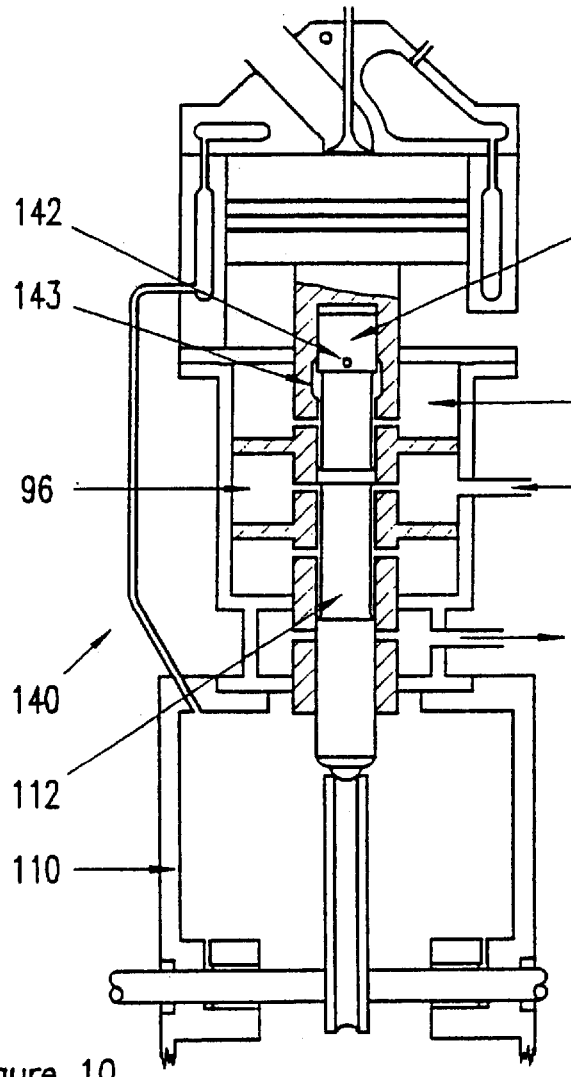
FIGS. 10 to 13 illustrate in similar views to FIGS. 6 to 9 respectively, an alternative embodiment of cylinder unit according to the invention.
Figure 11:
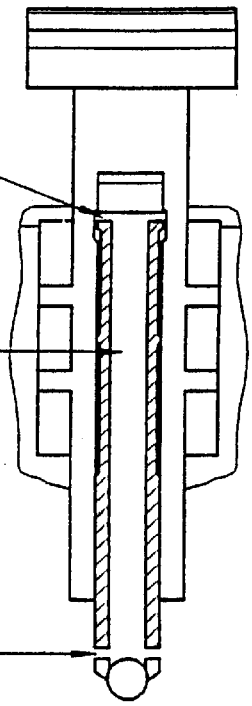
Figure 12:
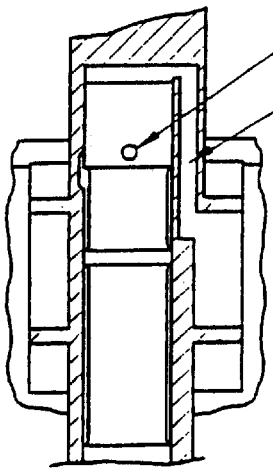
Figure 13:
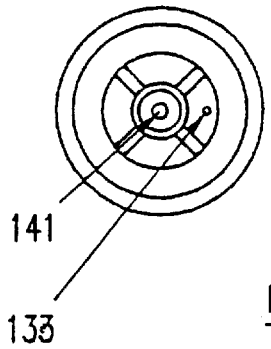

As shown more clearly in FIGS. 7 and 9, the piston rod 97 which is coupled to the piston 92 is provided with a pair of elongated passages 123 which extend longitudinally of the piston rod 97 open through ports 124 into the bore 108. At their opposite ends, the passages 123 open through the end of the piston rod 97 at 125 into the casing 110. A further passageway 126 extends from the cam casing 110 to a cylinder jacket 127 surrounding the engine cylinder 91. Fluid may also be communicated from the cylinder jacket 127 through communicating ports 128 with coolant chambers 129 within the cylinder head 130 of the engine.

The piston/cylinder assembly 90 described above functions in a similar manner to that described in my aforesaid International patent application. Thus assuming the piston 92 is at the lower end of its stroke within the cylinder 91 and that the engine of which the piston/cylinder assembly 90 is a part is a four cycle engine, the cam shaft 122 is rotated to cause the cam 121 to move the slide valve member 112 within the bore 108 so that hydraulic fluid is supplied through the port 109 to pass into the casing 110, port 106, groove 116 and port 105 into the chamber 102. This will cause the piston assembly 96 to be driven upwardly because the fluid acts between the piston 99 and end wall 103. At the same time fluid in the chamber 101 is forced through port 107, groove 117, and into the ports 124 and passages 123 to flow into the casing 101.

The piston 92 will thus be driven upwardly compressing a fuel charge which has been supplied into the cylinder 91 by a conventional fuel supply arrangement.

Ignition of the charge within the cylinder 91 drives the piston 92 and the coupled piston rod 97 downwardly from the top position whilst at the same time the cam 121 has retracted the slide valve 112 thereby closing communication between the supply port 109 and chamber 102 but opening communication between the chamber 102 and port 104 through groove 116. Thus fluid in the chamber 102 which is under high pressure due to the force applied by the ignited charge to the piston 92 is forced out upon downward movement of the piston 91 through the port 106, groove 116 and port 104 into a gallery 131 where it is directed through port 132 to do useful work for example for driving an hydraulic motor, and thence returned to a reservoir to be stored for future use. At the same time, the land 115 blocks the port 124 and communication is opened between the port 106 and chamber 101 through the groove 117 and port 107 so that hydraulic fluid is admitted thereto.

Further upward movement of the slide valve member 112 gain by the cam 121 then causes fluid to be admitted to the chamber 102 due to communication being re-established between the ports 105 and 106 through the groove 106. This causes the piston assembly 112 to be displaced upwardly causing the piston 92 to rise in cylinder 91 thereby causing exhaust gases therein to be discharged through an exhaust valve in the head 130 in conventional fashion. At the same time, the valve member 112 opens communication between the chamber 107 and ports 124 due to the land 115 uncovering the ports 124 so that hydraulic fluid is forced from chamber 101 into the casing 110 for use as before.

Further movement of the cam 121 then causes movement of the slide valve member 112 to be reversed so that again fluid is directed from the chamber 100 into the chamber 107 whilst chamber 102 is connected to the port 104. This causes the piston assembly 96 to retract carrying with it the piston 92 which serves to draw in through the inlet valve in the head 130 of the cylinder 91 a fresh cylinder charge.

Fluid discharged into the cam casing 110 during the above reciprocation acts as a lubricant within the cam casing 110 and then is expelled through the passage 126 into the engine cylinder and head jackets 127 and 129 acting as a coolant. The fluid may then be directed to a suitable heat exchanger and returned for further use.

In non-fluid cooled applications the fluid may be discharged directly from the cam casing 110 for further use.

Figure 8:
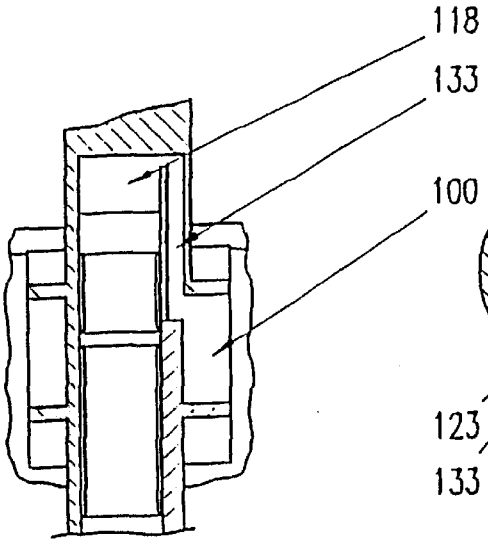
FIG. 8 is a further rotated section through a part of the cylinder unit displaying another part of the modified porting.

The spring biasing means 119 acting against the slide valve member 112 may be eliminated and replaced by a passage 133 (see FIGS. 8 and 9) leading from the supply chamber section 100 through the side valve member 112 to the chamber 118 previously housing the spring biasing means to supply this area with hydraulic fluid under pressure to act against the slide valve member 112. This fluid acts against the end of the valve member 112 which serves as a piston and biases the slide valve member 112 against the rotatable cam 112.

The slide valve member end which is adjacent the rotatable cam 112 may have as a cam follower 120 a ball or roller cam follower or hydraulic lifter or a combination thereof. The slide valve member 112 itself may be hollow with suitable end fittings to prevent loss of the fluid now acting as the biasing means. In the above modifications, the spring biasing means 119 may also be retained to act in conjunction with the hydraulic biasing means.

FIGS. 10 to 13 illustrate an alternative embodiment of cylinder/piston unit 140 similar to the embodiment of FIGS. 6 to 9 and in which like components have been given like numerals. In this case, the passages 123 provided in the piston assembly 96 are eliminated and replaced by an internal passage 141 extending longitudinally of and within the valve member 112. Ports 142 communicate one end of the passage 142 through the land 115 with an annular groove 143. Communication between the groove 143 and chamber section 101 varies in accordance with the position of the land 115 which is capable of blocking or allowing this communication in a similar manner to which the land 115 of the embodiment of FIGS. 6 to 9 blocks or opens the ports 124. The other end of the passage 141 communicates through ports 114 opening into the casing 110.

This embodiment functions in the same manner as described with reference to FIGS. 6 to 9 with discharge fluid passing from the chamber 101 and through passage 141 into the casing 110 for use as before.

Engines of this type may be single or multi-cylindered with their cylinders arranged in any suitable configuration and may be of either two or four cycle or interchangeably both. In a typical arrangement, the cylinders may be arranged to extend from a common cam casing which replaces the single casing 110 associated with the separate cylinder units.

Whilst the above has been given by way of illustrative embodiment of the invention, all such modifications and variations thereto as would be apparent to persons skilled in the art are deemed to fall within the broad scope and ambit of the invention as defined in the appended claims.

I claim:

1. A fluid actuator assembly for use with an engine operating mechanism, said fluid actuator assembly including a chamber having first and second opposite ends, a piston arranged for reciprocating movement within said chamber, an actuating member extending from one end of said piston and through said chamber, and control valve means arranged externally of said chamber for controlling the simultaneous supply and release of fluid to and from said chamber, said valve means in a first attitude simultaneously supplying and releasing fluid to and from said chamber to cause said piston and actuating member to move in a first direction, said valve means in second attitude simultaneously supplying and releasing fluid to and from said chamber to cause said piston and actuating member to move in a second direction opposite said first direction and means for decelerating and cushioning movement of said piston as said piston approaches at least one end of said chamber including throttling means on an end of said piston adjacent said one end of said chamber adapted to be received in a bore communicating with said chamber through which said fluid flows, said throttling means cooperating with said bore to increasingly reduce flow of fluid from said chamber as said piston approaches said one end thereof, wherein said bore is formed in a movable plug engaged with said one end of said chamber.

2. A fluid actuator assembly for use with an engine operating mechanism, said fluid actuator assembly including a chamber, a piston arranged for reciprocating movement within said chamber, an actuating member extending from one end of said piston and through said chamber, and control valve means arranged externally of said chamber for controlling the simultaneous supply and release of fluid to and from said chamber at opposite ends of the piston, said valve means in a first attitude simultaneously supplying and releasing fluid to and from said chamber to cause said piston and actuating member to move in a first direction, said valve means in second attitude simultaneously supplying and releasing fluid to and from said chamber to cause said piston and actuating member to move in a second direction opposite said first direction.

3. A fluid actuator assembly according to claim 2 wherein said chamber includes first and second opposite ends and including means for decelerating or cushioning movement of said piston as said piston approaches at least one end of said chamber.

4. A fluid actuator assembly according to claim 3 wherein said decelerating and cushioning means comprises means for limiting escape of fluid from said at least one end of said chamber.

5. A fluid actuator assembly according to claim 4 wherein said decelerating or cushioning means includes throttling means on an end of said piston adjacent said one end of said chamber adapted to be received in a bore communicating with said chamber through which said fluid flows, said throttling means cooperating with said bore to increasingly reduce flow of fluid from said chamber as said piston approaches said one end thereof.

6. A fluid actuator assembly according to claim 5 wherein said throttling means includes land means on said piston, said land means having a cross section which decreases away from said piston.

7. A fluid actuator assembly according to claim 3 and including decelerating or cushioning means at the opposite end of said chamber for decelerating or cushioning movement of said piston as it approaches either end of said chamber.

8. A fluid actuator assembly according to claim 7 wherein said decelerating or cushioning means at the member end of said chamber comprises a flared portion of said actuating member adjacent said piston.

9. A fluid actuator assembly according to claim 2 wherein said valve means includes a valve chamber and a single valve means slidable within said valve chamber.

10. A fluid actuator assembly according to claim 2 wherein said engine operating mechanism comprises a fuel injector and wherein said actuating member comprises a plunger arranged for reciprocation within an injection chamber.

11. A fluid actuator assembly according to claim 10 wherein said injection chamber communicates with said control valve means and wherein said fluid for operating said actuator assembly comprises the working fluid for an engine for injection upon reciprocation of said plunger.

12. A fluid actuator assembly according to claim 11 wherein said injection chamber communicates with said control valve means through one way valve means and is arranged to receive fluid from said control valve means simultaneous with said control means causing retracting movement of said piston.

13. A fluid actuator assembly according to claim 2 wherein said engine operating mechanism comprises an engine exhaust or inlet valve and wherein said actuating member is connected to or formed with a valve head of said engine valve.

14. A fluid actuator assembly according to claim 13 and including means for continuously supplying fluid to one end of said chamber adjacent one end of said piston.

15. A fluid actuator assembly according to claim 14 wherein said fluid in said one end of said chamber is directed to the opposite end of said chamber upon said piston being advanced into one end of said chamber.

16. A fluid actuator assembly according to claim 10 wherein a single pump communicates with said control valve means for supplying said fluid to said chamber and to said injection chamber.

17. The fluid actuator according to claim 10, wherein the cross-sectional working area of the plunger 13 is smaller than the working face of the piston exposed to the fluid supply of the chamber whereby pressure amplification is obtained.

* * * * *